US008302284B2

(12) United States Patent
Gharib et al.

(10) Patent No.: US 8,302,284 B2
(45) Date of Patent: Nov. 6, 2012

(54) APPARATUS AND METHOD FOR SECURING AN END CAP TO A SHELL

(75) Inventors: Mohamed Gharib, Cambridge (CA); Michael W. Van Heurn, Brantford (CA)

(73) Assignee: Upland Technologies Inc., Cambridge, ON (CA)

( * ) Notice: Subject to any disclaimer, the term of this patent is extended or adjusted under 35 U.S.C. 154(b) by 450 days.

(21) Appl. No.: 12/674,912

(22) PCT Filed: Sep. 5, 2008

(86) PCT No.: PCT/CA2008/001563

§ 371 (c)(1),
(2), (4) Date: Feb. 24, 2010

(87) PCT Pub. No.: WO2009/030030

PCT Pub. Date: Mar. 12, 2009

(65) Prior Publication Data

US 2011/0086751 A1 Apr. 14, 2011

Related U.S. Application Data

(60) Provisional application No. 60/935,868, filed on Sep. 5, 2007.

(51) Int. Cl.
*B21D 39/00* (2006.01)
*B31B 1/26* (2006.01)

(52) U.S. Cl. ..... 29/509; 493/162

(58) Field of Classification Search ..... 29/428, 29/463, 509, 513, 521, 243, 243.5; 493/162
See application file for complete search history.

(56) References Cited

U.S. PATENT DOCUMENTS

| | | | |
|---|---|---|---|
| 1,826,506 | A | 10/1931 | Cotes |
| 2,516,322 | A | 7/1950 | Jacokes |
| 3,672,317 | A | 6/1972 | Halling et al. |
| 4,513,487 | A | 4/1985 | Binnie |
| 4,574,607 | A | 3/1986 | Akino et al. |
| 5,107,579 | A | 4/1992 | Kostermeier |
| 6,000,115 | A | 12/1999 | Takagi et al. |

FOREIGN PATENT DOCUMENTS

WO WO2009/030030 3/2009

*Primary Examiner* — John C Hong

(57) ABSTRACT

An apparatus for securing an end cap including an end cap flange to a shell including a shell flange by forming a lip portion including the end cap flange and the shell flange into a lock seam portion in which the end cap flange and the shell flange are engaged with each other. The apparatus includes an elongate tool element rotatable about the central axis, for receiving the end cap thereon. The apparatus also includes a number of roller subassemblies for forming the lip portion into the lock seam portion. Each roller subassembly includes a forming roller engageable with the lip portion while the tool element rotates. Each roller subassembly also includes an arm on which the forming roller thereof is rotatably mounted, and a support mechanism for positioning the arm to engage the forming roller with the lip portion.

13 Claims, 14 Drawing Sheets

APPARATUS AND METHOD FOR SECURING AN END CAP TO A SHELL

FIELD OF THE INVENTION

The present invention is an apparatus and a method for securing an end cap to a shell.

BACKGROUND OF THE INVENTION

Shells of various cross-sectional shapes (e.g., oval or irregular shapes) are used in many products, such as automotive mufflers. Typically, the shell is elongate, and one or more end caps are mechanically locked (or secured) to the shell by a process known as seaming (or lockseaming), to form a housing defining one or more chambers therein. As is well known in the art, the process involves rotating the body portion and end caps around a central axis and engaging the end caps with forming rollers. Typically, two forming rollers (e.g., a curling roller and a flattening roller) are used to perform two forming operations sequentially. These are generally referred to as the curling and flattening operations respectively. However, the prior art seaming processes do not necessarily include both the curling and flattening operations.

A typical seaming process involving the curling and flattening operations on shells with oval or irregular shapes and the apparatus therefor is illustrated in FIGS. 1A-1C, 2, and 3. (The balance of the drawings illustrate the invention herein.) In the typical seaming process, an end cap flange 10 of an end cap 12 and a shell flange 11 on a shell 13 (FIG. 1A) are formed into a lock seam portion 14 (FIG. 1C), as shown in FIGS. 1A-1C. As can be seen in FIG. 1A, in the prior art, the end cap 12 is positioned on a mandrel 17 in tooling 18 (FIG. 2). Also, the end cap 12 is adapted to receive at least a part of the shell 13 thereon to locate the shell flange 11 in a predetermined position relative to the end cap flange 10, so that a lip portion 19 is thereby defined (FIG. 1A).

For example, the end cap flange 10 typically has a length "$L_1$" of approximately 0.625-0.75 inches (16-19 mm.), and the typical shell flange has a length "$L_2$" of approximately 0.234-0.273 inches (6-7 mm.) (FIG. 1A). Accordingly, the end cap flange 10 typically is about 10 mm. longer than the shell flange 11. Also, when the shell flange 11 is in the predetermined position relative to the end cap flange 10, the flanges 11, 10 are substantially abutting each other.

Once the end cap 12 is on the tooling 18 and the shell 13 is properly positioned on the end cap 12 and the tooling 18, the tooling 18 is rotated about a central axis 24 thereof (FIGS. 2, 3).

Next, a curling roller 22 is engaged with the lip portion 19. While the tooling 18 is rotated about the axis 24 thereof, the curling roller 22 is urged against the lip portion 19, i.e., in the direction indicated by arrow "A".

As a result of the engagement of the curling roller 22 with it, the lip portion 19 is thereby formed into a curled portion 26 (FIG. 1B), i.e., the curling operation is then completed. Next, the flattening operation is performed. Typically, while the tooling 18 is rotating, a flattening roller 28 is urged against the curled portion 26 (i.e., in the direction indicated by arrow "B" in FIG. 1C), pressing the curled portion 26 against the shell 13 to form the curled portion 26 into the lock seam portion 14 (FIG. 1C).

It will also be understood that another end cap typically is also secured at the other end of the shell 13. To simplify the illustration, only the attachment of one end cap 12 to the shell 13 is shown. A housing 27 is formed when one or more end caps (i.e., as the case may be) are secured to the shell 13 (FIG. 1C).

As can be seen in FIG. 1A, the curling roller 22 includes an engagement surface 23 with which the lip portion 19 is engaged. The engagement surface 23 is designed to form the lip portion 19 into the curled portion 26. Also, and as can be seen in FIG. 1C, the flattening roller 28 includes an engagement surface 29 for engaging the curled portion 26, and forming the curled portion 26 into the lock seam portion 14.

As is well known in the art, various approaches may be taken to forming the lock seam portion. For example, instead of a curling operation and a flattening operation, the seaming process may involve two curling operations. The foregoing description of the curling and flattening operations is only one example of the prior art seaming process. Accordingly, for the purposes hereof, the curled portion is considered to be a modified lip portion.

In FIGS. 2 and 3, the apparatus of the prior art for performing the prior art seaming process is shown. The prior art apparatus includes the tooling 18 which has an inner cam track 30 with an inner cam surface 31. As can be seen in FIG. 2, the tooling 18 also includes an outer cam track 32 with an outer cam surface 35. The inner cam track 30 has substantially the same shape as the end cap's outline, but the inner cam track 30 is smaller than the end cap 12, and fits inside the end cap 12.

In the prior art process, the tooling 18 is rotated around the central axis 24, i.e., in the direction indicated by arrow "C". Cam followers 38*a*, 38*b* are positioned between the inner cam track 30 and the outer cam track 32, and engage the inner and outer cam track surfaces 31, 35 while the tooling 18 rotates. As can be seen in FIGS. 2 and 3, the cam followers 38*a*, 38*b* are rotatably mounted on main arms 40*a*, 40*b*. The main arms 40*a*, 40*b* oscillate around shaft points 42, 44 respectively as the tooling 18 rotates. While the tooling 18 rotates, the centers of the cam followers 38*a*, 38*b* substantially follow a path 45 approximately midway between the inner and outer cam surfaces 31, 35.

The prior art apparatus also typically includes forming rollers 48*a*, 48*b* which are also mounted on arms 34*a*, 34*b* respectively. Each arm 34*a*, 34*b* is rotatable around a pivot point 36*a*, 36*b* respectively, and the arms 34*a*, 34*b* are powered by hydraulic cylinders 46*a*, 46*b* respectively. The hydraulic cylinders 46*a*, 46*b* are adapted to move the arms 34*a*, 34*b* between a retracted position (shown in FIGS. 2, 3) and an extended position (not shown).

In the prior art, the forming rollers 48*a*, 48*b* typically are positioned substantially at 180° apart from each other. Also, as can be seen in FIGS. 2 and 3, the main arms 40*a*, 40*b* typically are positioned so as to substantially "mirror" each other.

As indicated in FIGS. 2 and 3, the end cap 12 is placed on the mandrel 17, so that the end cap 12 is supported thereon, and a part of the shell is positioned on the end cap. While the tooling 18 rotates about the center 24, the main arms 40*a*, 40*b* oscillate and the cam followers 38*a*, 38*b* are generally maintained on the path 45 by the inner and outer cam tracks 30, 34. As is known, the cam followers 38*a*, 38*b* are rotatably mounted on the main arms 40*a*, 40*b*. Also, the forming rollers 48*a*, 48*b* are connected to the main arms 40*a*, 40*b* respectively, in two places namely: (i) via the hydraulic cylinders 46*a*, 46*b*; and (ii) via the pivot points 36*a*, 36*b*. In this way, the forming rollers 48*a*, 48*b* are indirectly supported by the cam followers 38*a*, 38*b*. The forming rollers 48*a*, 48*b* engage the lip portion 10, ultimately forming the lip portion 10 into the lock seam portion.

For clarity of illustration, an original edge 16 (i.e., an initial edge thereof, prior to engagement of the lip portion 19 by the forming rollers) of the lip portion 19 is shown in dashed outline. Also, the lock seam portion 14 is shown in solid outline, to simplify the illustration. It will be evident to those skilled in the art that FIGS. 2 and 3 generally show the end cap 12 after the seaming process has been completed.

For example, when the tooling 18 rotates from the position shown in FIG. 2 to the position shown in FIG. 3, the main arms 40*a*, 40*b* both pivot inwardly about the shaft points 42, 44 respectively (i.e., in the directions indicated by arrows "D" and "E" respectively), substantially simultaneously. Similarly, when the tooling 18 rotates from its position as shown in FIG. 3 to its position shown in FIG. 2, the main arms 40*a*, 40*b* pivot outwardly (i.e., in the directions as indicated by arrows "F" and "G"), substantially simultaneously.

The prior art has a number of disadvantages. For instance, the prior art tooling is required to be very heavy and, as a result, is relatively expensive. In addition, because of the large mass of the tooling, changing the tooling is difficult, and therefore the process of changing the tooling (which is required to be done from time to time) is also relatively expensive. As is well known in the art, the tooling 18 preferably is rotated relatively rapidly, e.g., about 60 rpm. Because of this, oscillation of the arms 40*a*, 40*b* is relatively rapid, subjecting the main arms 40*a*, 40*b* to relatively high rates of acceleration and deceleration.

Accordingly, a relatively large amount of power is required to operate the prior art apparatus. During operation, the tooling 18 is rotated at a substantially constant speed. First, power (i.e., torque) is required to rotate the tooling 18, and second, power is required to position the main arms 40*a*, 40*b* to form the lip portion 10 into the lock seam portion 14, to secure the end cap 12 to the shell 13.

Yet another disadvantage of the prior art apparatus is the significant noise resulting from the operation thereof. The noise generally results from shifts in pressure exerted by the cam followers 38*a*, 38*b*, i.e., the cam followers 38*a*, 38*b* alternately pressing primarily first on the inner cam track surface and next on the outer cam track surface and vice versa, while the tooling 18 rotates.

SUMMARY OF THE INVENTION

For the reasons as set out above, there is a need for an improved apparatus and method for securing an end cap to a shell.

In its broad aspect, the invention provides an apparatus for securing one or more end caps including an end cap flange to a shell including a shell flange by forming a lip portion including the end cap flange and the shell flange into a lock seam portion in which the end cap flange and the shell flange are engaged with each other. The apparatus includes an elongate tool element at least partially defined by a central axis thereof and rotatable about the central axis. The tool element is adapted for receiving said at least one end cap thereon. The end cap is adapted to receive at least part of the shell thereon to locate the shell flange in a predetermined position relative to the end cap flange. The apparatus also includes a number of roller subassemblies for forming the lip portion into the lock seam portion. Each roller subassembly includes a forming roller engageable with the lip portion while the tool element rotates. Also, each roller subassembly additionally includes an arm on which the forming roller thereof is rotatably mounted, and a support mechanism for positioning the arm to engage the forming roller with the lip portion.

In another aspect, the invention provides a hydraulic system including a hydraulic fluid, and a pump for utilizing energy inputs therein to subject the hydraulic fluid to positive pressure in a positive direction relative to the pump. The apparatus also includes a number of hydraulic cylinders, the hydraulic cylinders being the support mechanisms of the roller subassemblies respectively, each hydraulic cylinder being in fluid communication with the other hydraulic cylinders and with the pump.

Each hydraulic cylinder is adapted to subject the hydraulic fluid to alternating positive pressures and negative pressures as the tool element rotates, the forming rollers being positioned relative to the central axis and relative to each other so that the positive and negative pressures at least partially offset each other, for optimizing (i.e., minimizing) the energy inputs to the pump.

In another of its aspects, the invention provides an elongate tool element at least partially defined by a central axis thereof and rotatable about the central axis, the tool element being adapted for receiving said at least one end cap thereon. The tool element also includes a cam surface thereon with a balancing profile.

The end cap is adapted to receiving at least part of the shell thereon to locate the shell flange in a predetermined position relative to the end cap flange. The apparatus also includes a number of roller subassemblies for forming the lip portion into the lock seam portion, each roller subassembly including a forming roller engageable with the lip portion while the tool element rotates. Each roller subassembly additionally includes an arm on which the forming roller thereof is rotatably mounted, and a forming hydraulic cylinder for positioning the arm to engage the forming roller with the lip portion. Also, the apparatus includes one or more idler subassemblies including an idler mounted on an idler arm, the idler arm being positioned by an idler hydraulic cylinder to engage the cam surface. The apparatus also includes a hydraulic system having a hydraulic fluid, and a pump for utilizing energy inputs therein to subject the hydraulic fluid to positive pressure in a positive direction relative to the pump.

The hydraulic system also includes the forming cylinders and the idler hydraulic cylinder, each forming hydraulic cylinder and the idler hydraulic cylinder being in fluid communication with each other and with the pump. Each forming hydraulic cylinder is adapted to subject the hydraulic fluid to alternating positive forming pressures and negative forming pressures while the tool element rotates. Also, the idler hydraulic cylinder is adapted to subject the hydraulic fluid to alternating positive idler pressures and negative idler pressures while the tool element rotates. The idler and the forming rollers are positioned relative to each other so that the positive and negative forming pressures and the positive and negative idler pressures at least partially offset each other. Also, the balancing profile is determined so that the positive and negative idler pressures substantially offset said positive and negative forming pressures, for optimizing (i.e., minimizing) the energy inputs.

In yet another aspect, two forming rollers and one idler are positioned substantially equidistant from each other measured radially relative to the central axis.

BRIEF DESCRIPTION OF THE DRAWINGS

The invention will be better understood with reference to the attached drawings in which.

DETAILED DESCRIPTION

Figure 1A:
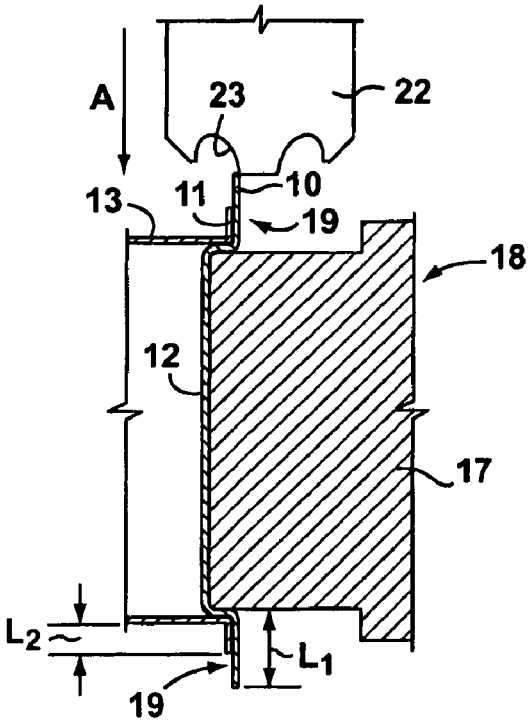
FIG. 1A (Prior Art)
FIG. 1A (also described previously) is a cross-section of a shell and an end cap positioned on prior art tooling, with a prior art roller engaging a lip portion.
Figure 1B:
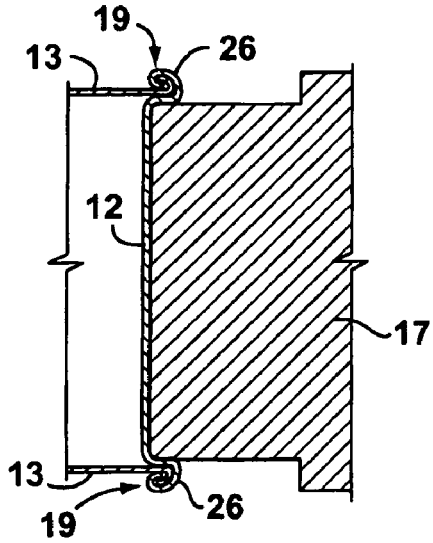
FIG. 1B (Prior Art)
FIG. 1B (also described previously) is a cross-section of the shell and end cap of FIG. 1A with the lip portion of FIG. 1A formed into a curled lip portion.
Figure 1C:
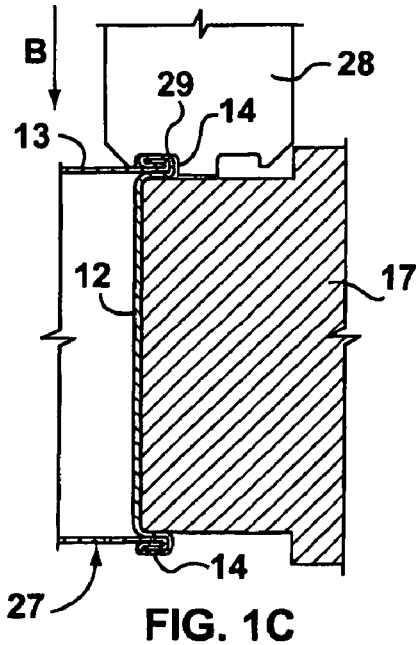
FIG. 1C (Prior Art)
FIG. 1C (also described previously) is a cross-section of the shell and end cap of FIG. 1B with the curled lip portion of FIG. 1B formed into a lock seam portion.
Figure 2:
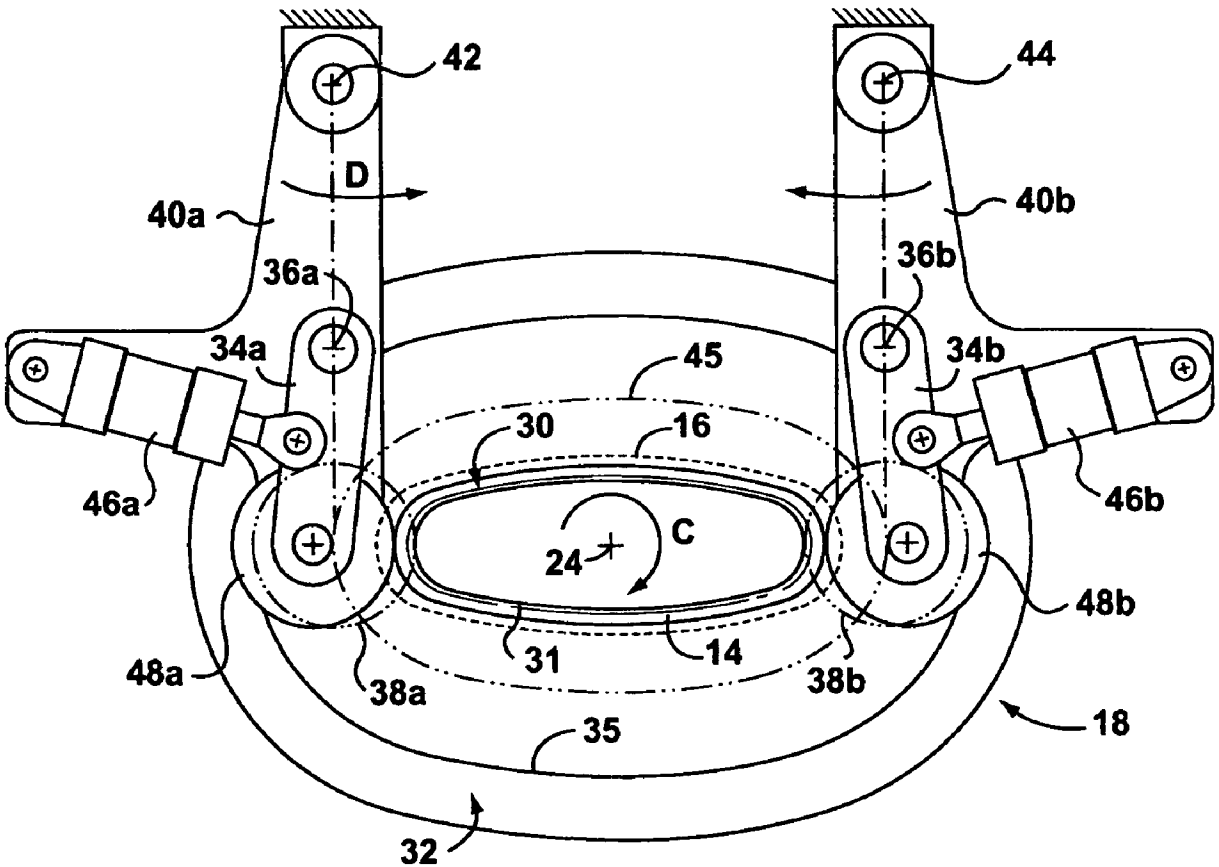
FIG. 2 (Prior Art)
FIG. 2 (also described previously) is an end view of the end cap of FIG. 1A positioned in prior art tool, drawn at a smaller scale.
Figure 3:
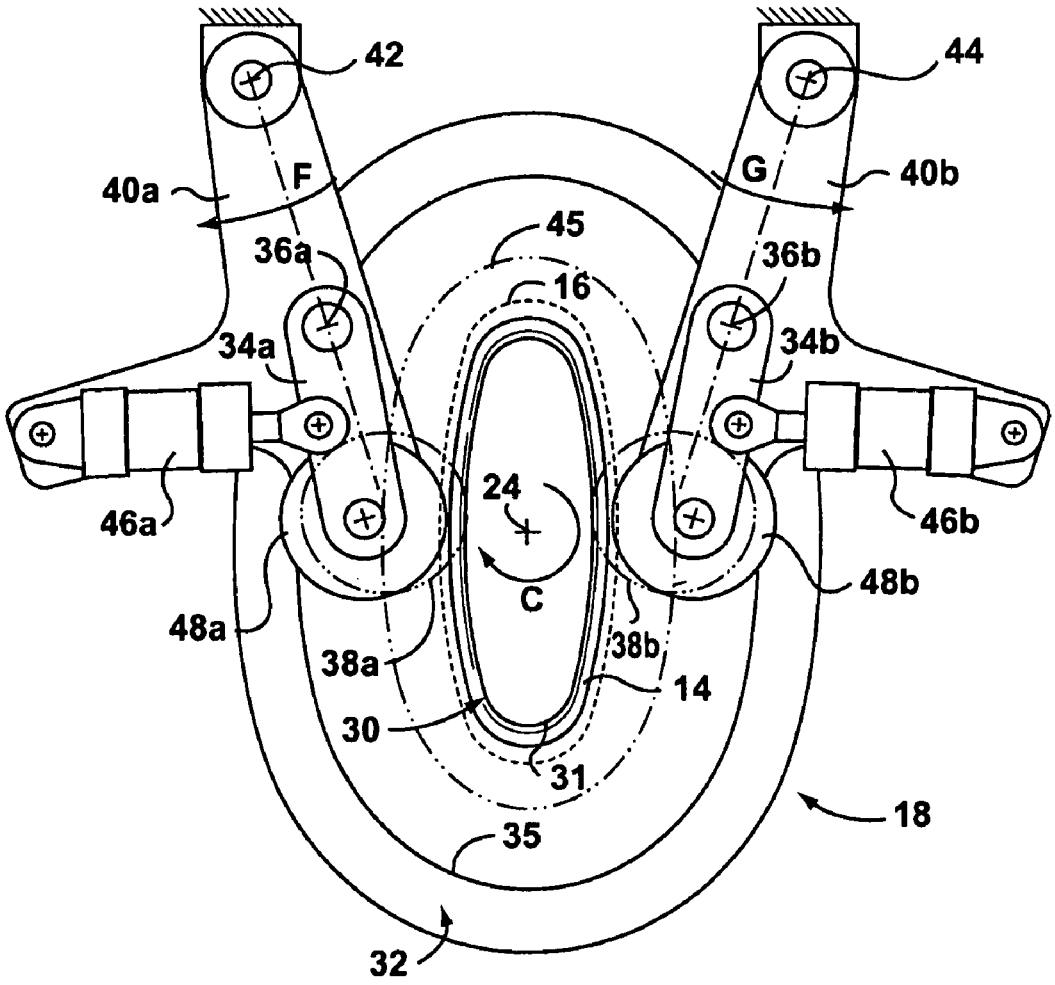
FIG. 3 (Prior Art)
FIG. 3 (also described previously) is another end view of the end cap and tooling of FIG. 2, after the tooling has rotated approximately 90° about a central axis thereof.
Figure 4:
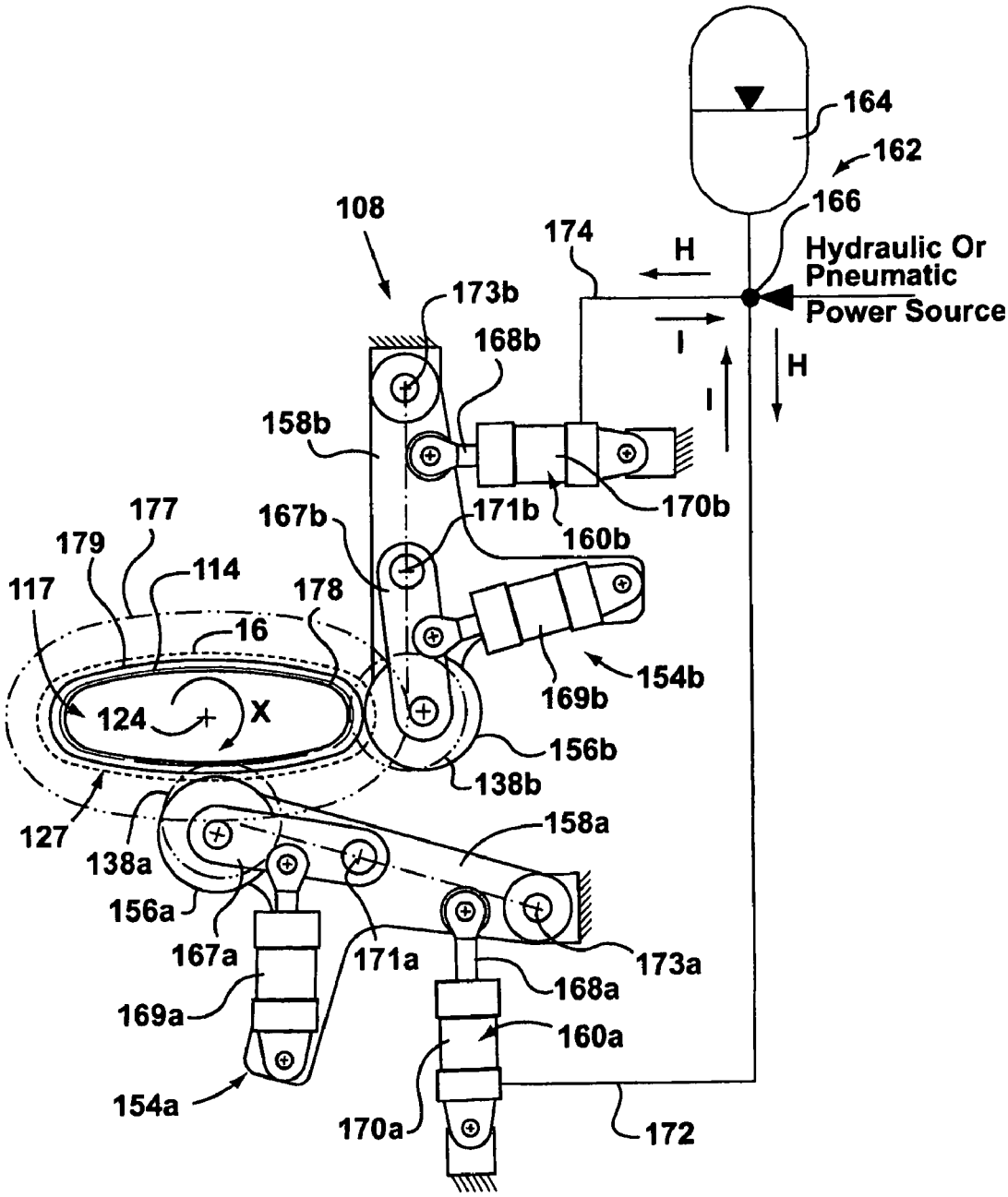
FIG. 4 is, in part, an end view of an embodiment of the apparatus of the invention in which a shell and an end cap are positioned on a rotatable tool element thereof, drawn at a smaller scale, and, in part, a schematic illustration of a portion of the embodiment.
Figure 5:
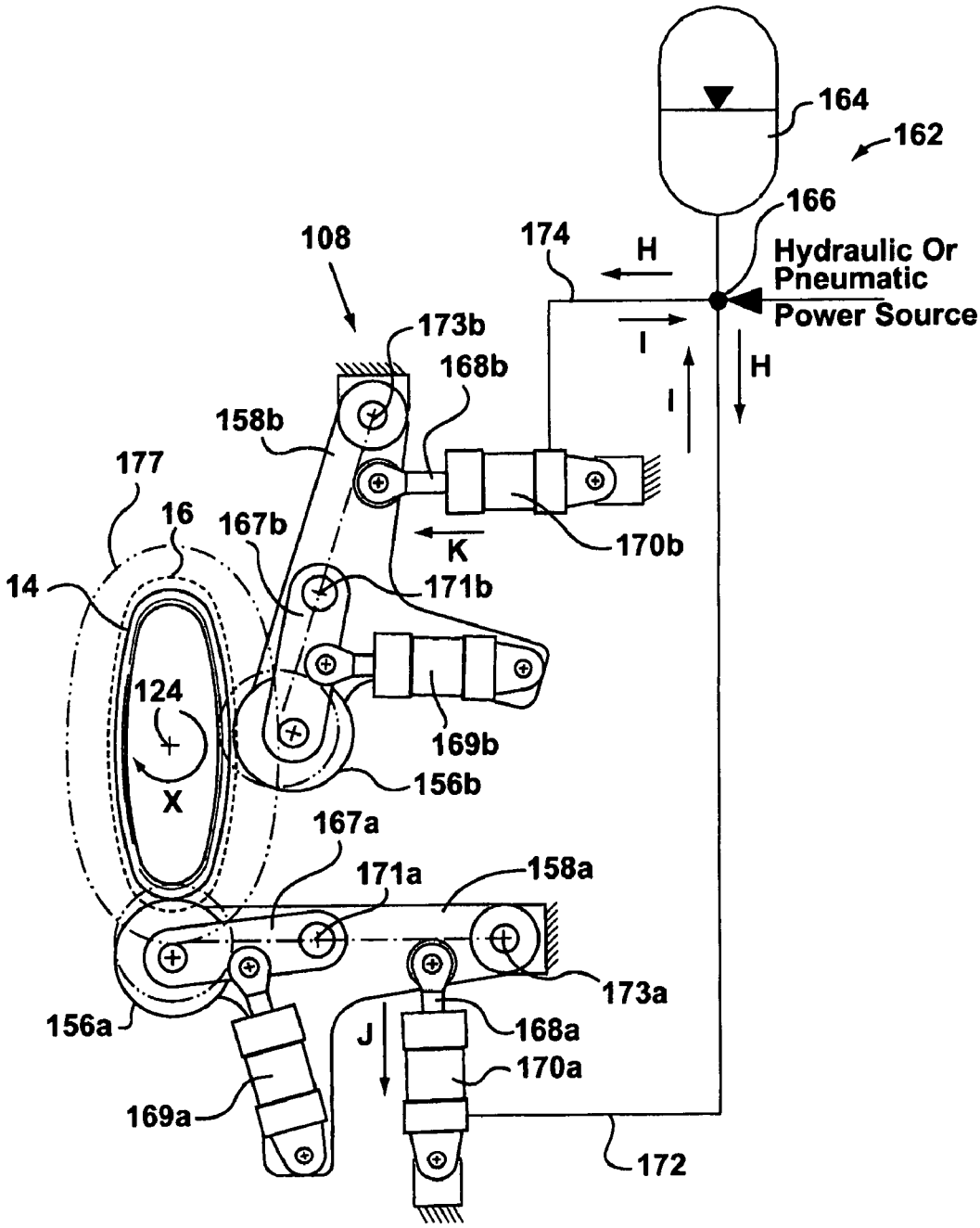
FIG. 5 is, in part, an end view of the apparatus of FIG. 4 after the tool element has rotated approximately 90° about a central axis thereof, and, in part, a schematic illustration of a portion of the embodiment.

Reference is first made to FIGS. 4 and 5 to describe an embodiment of an apparatus of the invention indicated generally by reference numeral 108. The apparatus 108 is for securing one or more end caps 12 (each end cap 12 including the end cap flange 10) to the shell 13 (the shell 13 including the shell flange 11) by forming the lip portion 19 including the end cap flange 10 and the shell flange 11 into a lock seam portion 114 in which the end cap flange 10 and the shell flange 11 are engaged with each other. The apparatus 108 includes an elongate tool element 117 at least partially defined by a central axis 124 thereof and rotatable about the central axis 124. The tool element 117 is adapted for receiving the end cap 12 thereon. Also, the end cap 12 is adapted to receive at least a part of the shell 13 to locate the shell flange 11 in a predetermined position relative to the end cap flange 10. Preferably, the apparatus 108 also includes a number of roller subassemblies 154 for forming the lip portion 10 into the lock seam portion 114. Each roller subassembly 154 preferably includes a forming roller 156 engageable with the lip portion 10 while the tool element 117 rotates. It is also preferred that each roller subassembly 154 additionally includes an arm 158 on which the forming roller 156 is rotatably mounted, and a support mechanism 160 for positioning the arm 158 to engage the forming roller 156 with the lip portion.

For clarity of illustration, an original (i.e., initial) edge 16 of the lip portion 19 is shown in FIGS. 4 and 5 in dashed outline. Also, the lock seam portion 114 is shown in solid outline, to simplify the illustration. The lock seam portion 114 formed by the apparatus 108 is at least partially defined by an outer edge 179 thereof (FIG. 4).

The tool element 117 rotates about its central axis 124 in the direction indicated by arrow "X". From the foregoing, it can be seen that, due to the tool element 117 having significantly less mass than the prior art tooling 18, in the apparatus 108, significantly less torque is required to rotate the tool element 117 than the prior art tooling 18. In addition, because the tool element 117 has much less mass than the tooling 18, changes in the tool element 117 are much easier and therefore more quickly effected, and less expensive.

Preferably, the apparatus 108 includes a hydraulic system 162 including a hydraulic fluid (schematically referred to by reference numeral 164 in FIG. 4) and a pump 166 for utilizing energy inputs therein (i.e., from a power source) to subject the hydraulic fluid to positive pressure in a positive direction relative to the pump. In FIGS. 4 and 5, the positive direction is indicated by arrows "H". Hydraulic fluid under negative pressure (in a negative direction, i.e., opposite to the positive direction) produced at one hydraulic cylinder is transmitted to another hydraulic cylinder as positive pressure, thereby reducing the energy inputs required to maintain positive pressure, as will be described. In FIGS. 4 and 5, the direction in which negative pressure is exerted is indicated by arrows "I".

The apparatus 108 preferably also includes one or more hydraulic cylinders. The hydraulic cylinders preferably are (or include) the support mechanisms 160 of the roller assemblies 154 respectively. Each hydraulic cylinder 160*a*, 160*b* preferably is in fluid communication with the other hydraulic cylinder, and also with the pump 166. It is also preferred that each hydraulic cylinder 160 is adapted to subject the hydraulic fluid to alternating positive pressures and negative pressures as the tool element 117 rotates, as will be described. The forming rollers 156 preferably are positioned relative to the central axis 124 and relative to each other so that the positive and negative pressures at least partially offset each other, for optimizing the energy inputs to the pump.

For example, and as can be seen in FIGS. 4 and 5, where the apparatus 108 includes two roller subassemblies 154*a* and 154*b*, the forming rollers 156*a* and 156*b* thereof respectively are positioned substantially at 90° from each other measured radially relative to the central axis 124. The forming rollers 156*a*, 156*b* are supported by the arms 158*a*, 158*b*, as will be described. The arms 158*a*, 158*b* are pivotable about pivot points 173*a*, 173*b*.

As is known, each hydraulic cylinder 160*a*, 160*b* includes a piston 168*a*, 168*b* and a cylinder housing 170*a*, 170*b* respectively. To simplify the illustration, only a piston arm portion of each piston 168*a*, 168*b* is shown, it being understood that a piston portion of each piston 168*a*, 168*b* is located inside the cylinder housing 170*a*, 170*b*. As can be seen in FIGS. 4 and 5, when the tool element 117 rotates from the position shown in FIG. 4 to that shown in FIG. 5, the arm 158*a* (which supports the roller 156*a*) moves downwardly (i.e., in the direction indicated by arrow "J" in FIG. 5), so that the piston 168*a* in the hydraulic cylinder 160*a* is pushed downwardly, i.e., into the cylinder housing 170*a*. When it is pushed downwardly, the piston 168*a* pushes the fluid through the branch 172 in the negative direction. The movement of the arm 158*a* resulting from the movement of the tool element 117 through approximately 90° therefore subjects the hydraulic fluid in the branch 172 to negative pressures. Accordingly, due to such movement of the arm 158*a*, hydraulic fluid is pushed along branch 172 of the hydraulic system in the direction indicated by arrow "I".

Similarly, and at the same time, the rotation of the tool element 117 from its position in FIG. 4 to its position in FIG. 5 results in movement of the arm 158*b* (which supports the roller 156*b*) away from the cylinder housing 170*b* (i.e., in the direction indicated by arrow "K" in FIG. 5). This movement (i.e., an expansion of the hydraulic cylinder 170*b*) requires hydraulic fluid which is under positive pressure. In connection with such movement, hydraulic fluid moves along branch 174 in the direction indicated by arrow "H", i.e., in the positive direction, relative to the pump 166.

As is known, the pump 166 generates positive pressure, via the pump's utilization of energy inputs, e.g., electricity. However, to the extent that one of the hydraulic cylinders subjects the hydraulic fluid to negative pressure (i.e., flowing in a direction opposite to the direction of flow of hydraulic fluid which is under positive pressure), the amount of energy required by the pump to subject the hydraulic fluid to positive pressure is reduced, as will also be described.

For example, as described above, hydraulic fluid is pushed along branch 172 of the hydraulic system 162 in the direction indicated by arrow "I", due to rotation of the tool element 117. The hydraulic fluid pushed out of the hydraulic cylinder 160*a* travels through branch 172 in the direction indicated by arrow "I", pushing in the positive direction (i.e., in the direction indicated by arrow "H") along a branch 174 of the hydraulic system 162. Accordingly, the hydraulic fluid under negative pressure in the branch 172 is, from the point of view of the branch 174 (i.e., the hydraulic cylinder 160*b*), hydraulic fluid which is under positive pressure.

It will be understood that the "push" of hydraulic fluid (i.e., due to retraction of the piston 168*a* into the cylinder housing 170*a*) resulting from the rotation of the tool element 117 through approximately 90° may not necessarily quantitatively equal the substantially simultaneous "pull" resulting from withdrawal of the piston 168*b* from the cylinder housing 170*b*. As a result, energy is required to be input to operate the pump, to provide the difference in hydraulic fluid under an appropriate positive pressure to the hydraulic cylinder 160*b*. Accordingly, the positioning of the roller subassemblies is intended to optimize—i.e., minimize—energy inputs which are needed in order to maintain the forming rollers engaged with the lip portion.

It will also be understood that the foregoing discussion regarding positive and negative pressures resulting from the rotation of the tool element 117 through approximately 90° is exemplary. From the foregoing discussion, it can be seen that a further rotation of the tool element 117 by another 90° results in positive pressures generated by the hydraulic cylinder 160*a*, and negative pressures generated by the hydraulic cylinder 160*b*. It can also be seen that, in order to optimally position the roller subassemblies, the positive and negative pressures resulting from rotation of the tool element 117 through approximately 360° need to be taken into account.

As can be seen in FIGS. 4 and 5, in one embodiment, the apparatus 108 preferably includes cam followers 176*a*, 176*b*. The cam followers 176*a*, 176*b* are rotatably mounted on the main arms 158*a*, 158*b* respectively. The cam followers 176*a*, 176*b* preferably engage a cam 178 positioned in a plane spaced apart from the plane in which the forming rollers 156*a*, 156*b* are located. For instance, as illustrated in FIGS. 4 and 5, the cam followers 176*a*, 176*b* and the cam 178 are positioned behind the forming rollers 156*a*, 156*b*. A path 177 followed by the cam followers 176*a*, 176*b* is shown in FIGS. 4 and 5. Preferably, the cam 178 is substantially parallel to the outer edge 179 of the edge portion 14.

The forming rollers 156*a*, 156*b* preferably are rotatably mounted on arms 167*a*, 167*b* respectively. Through the arms 167*a*, 167*b*, the forming rollers 156*a*, 156*b* are connected to the main arms 158*a*, 158*b* respectively via supplemental hydraulic cylinders 169*a*, 169*b* and pivot points 171*a*, 171*b* respectively. It will be appreciated by those skilled in the art that the cam followers 176*a*, 176*b* are for providing indirect support to the forming rollers 156*a*, 156*b* respectively.

From the foregoing, it can be seen that the cross-sectional shape of the shell (and, therefore, of the end cap) has an impact on where the rollers are positioned in order to offset the positive and negative pressures resulting from rotation of the tool element to the greatest extent possible. It will also be clear from the foregoing that the embodiments of the invention may be used where the shell has a cross-sectional shape which is oval or irregular. In these circumstances, rotation of the tool element (and the shell located at least partly thereon) causes forming rollers engaged with the edge portion to oscillate radially, thereby resulting in the creation of alternating positive and negative pressures by hydraulic cylinders supporting the forming rollers. Accordingly, where the shell is substantially round in cross-section, because rollers engaged with the lip portion in this situation would not oscillate radially, the invention would not be advantageous.

It will be appreciated by those skilled in the art that any suitable fluid could be used as the working fluid in the hydraulic system. For example, the working fluid could be air or nitrogen (i.e., the system could be pneumatic). However, it is preferred that the working fluid is hydraulic oil. As shown in FIGS. 4 and 5, the hydraulic system preferably includes an accumulator.

INDUSTRIAL APPLICABILITY

Figure 9:
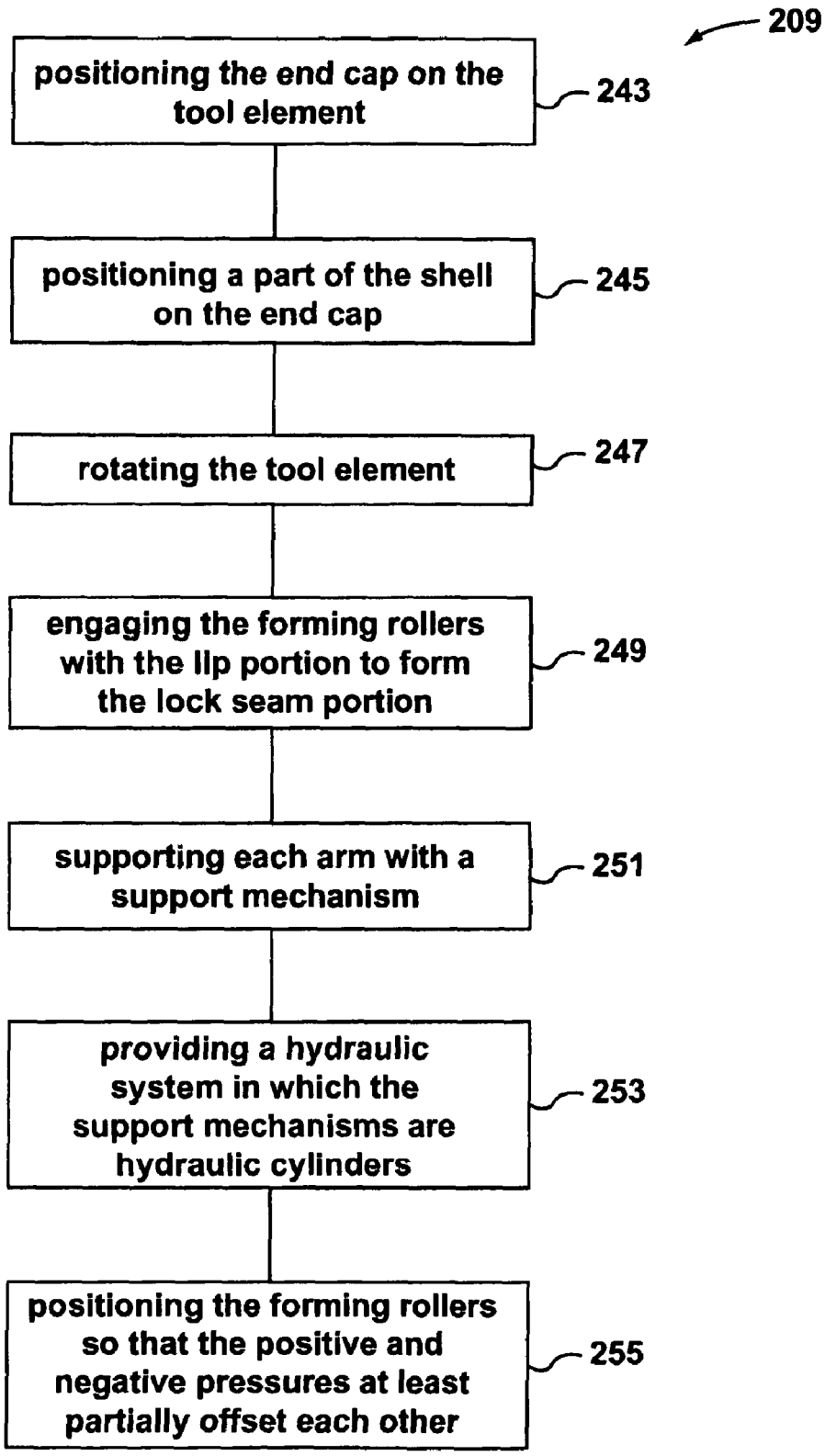
FIG. 9 is a schematic illustration of an embodiment of a method of the invention.

In use, an embodiment of a method 209 of the invention includes, first, positioning the end cap 12 on the tool element 117 (step 243, FIG. 9). At least a part of the shell 13 is positioned on the end cap 12 for locating the shell flange 11 in the predetermined position relative to the end cap flange 10 to define the lip portion 19 (step 245). The tool element 117 preferably is rotated about a central axis 124 thereof (step 247). Preferably, a number of forming rollers 156 are engaged with the lip portion 19 while the tool element 117 rotates, to form the lip portion 19 into the lock seam portion 14 (step 249). Each arm 158 preferably is supported with the support mechanism 160 respectively for positioning the arm 158 to engage the forming roller 156 mounted thereon with the lip portion 19 (step 251).

Preferably, the method additionally includes providing the hydraulic system 162 (step 253). Also, the method 209 preferably includes positioning the forming rollers 156 relative to each other so that the positive and negative pressures resulting from rotation of the tool element at least partially offset each other, for optimizing energy inputs into the pump 116 (step 255). Preferably, where there are more than two forming rollers, each forming roller is positioned substantially equidistant from each other measured radially relative to the central axis 124.

It can be seen from the foregoing, therefore, that a housing 127 is formable in accordance with the method 209. The housing is shown in FIG. 8A. The housing 127 is formed upon securing one or more end caps 12 (each end cap including the end cap flange 10) to the shell 13 (the shell 13 including the shell flange 11) by forming the lip portion including the end cap flange and the shell flange into the lockseam portion 14, in which the end cap flange 10 and the shell flange 11 are engaged with each other. The housing 127 preferably is formed by, first, positioning the end cap 12 on the tool element 117 (step 243, FIG. 9). At least a part of the shell 13 is positioned on the end cap 12 for locating the shell flange 11 in a predetermined position relative to the end cap flange 10 to define the lip portion 19 (step 245). The tool element 117 preferably is rotated about a central axis 124 thereof (step 247). A number of forming rollers 156 are engaged with the lip portion 19 while the tool element 117 rotates, to form the lip portion 19 into the lock seam portion 14 (step 249). Each arm 158 is supported with the support mechanism 160 respectively for positioning the arm 158 to engage the forming roller 156 mounted thereon with the lip portion 19 (step 251).

Preferably, the method of forming the housing 127 additionally includes providing the hydraulic system 162 (step 253). Also, the method 209 preferably includes positioning the forming rollers 156 relative to each other so that the positive and negative pressures resulting from rotation of the tool element at least partially offset each other, for optimizing energy inputs into the pump 116 (step 255).

Additional embodiments of the invention are shown in FIGS. 6-8A, 10A, and 10B. In FIGS. 6-8A, 10A, and 10B, elements are numbered so as to correspond to like elements in FIGS. 4, 5 and 9.

Figure 6:
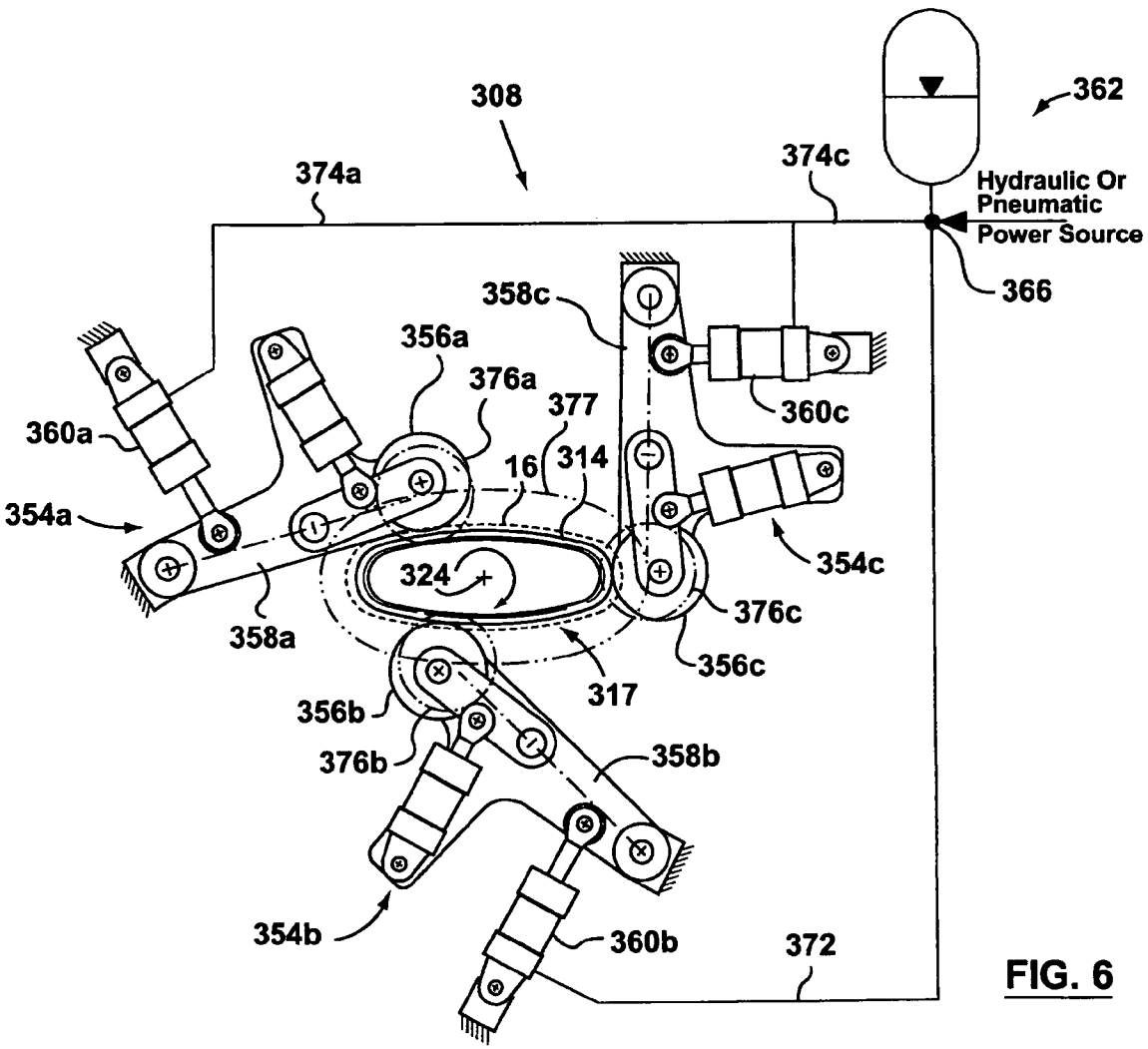
FIG. 6 is, in part, an end view of an alternative embodiment of the apparatus of the invention, and, in part, a schematic illustration of a portion of the embodiment.

An alternative embodiment of the apparatus 308 of the invention is disclosed in FIG. 6. As can be seen in FIG. 6, roller subassemblies 354*a*, 354*b*, and 354*c* include forming rollers 356*a*, 356*b*, and 356*c* respectively, for engagement with the lip portion 10 of the end cap 12 to form the lock seam portion 314. Preferably, and as shown in FIG. 6, each forming roller 356*a*, 356*b*, and 356*c* is substantially equidistant from each other measured radially relative to the central axis. For example, and as shown in FIG. 6, the forming rollers 356*a*, 356*b*, and 356*c* preferably are approximately 120° radially equidistant from each other respectively.

As can be seen in FIG. 6, the apparatus 308 also includes main arms 358*a*, 358*b*, and 358*c* on which cam followers 376*a*, 376*b*, and 376*c* are rotatably mounted respectively. The cam followers 376*a*, 376*b*, and 376*c* engage a cam 378.

Preferably, in the apparatus 308, the forming rollers 356*a*, 356*b*, and 356*c* respectively are positioned substantially at 120° from each other measured radially relative to the central axis. In one embodiment, the forming rollers are positioned substantially equidistant from each other radially relative to the central axis.

The forming rollers 356*a*, 356*b*, and 356*c* preferably are rotatably mounted on arms 367*a*, 367*b*, and 367*c* respectively. Preferably, the arms 367*a*, 367*b*, and 367*c* are supported by supplemental hydraulic cylinders 371*a*, 371*b*, and 371*c* respectively. The arms 367*a*, 367*b*, and 367*c* also preferably are connected to the main arms 358*a*, 358*b*, and 358*c* via the supplemental hydraulic cylinders 371*a*, 371*b*, and 371*c*, and also at the pivot points 369*a*, 369*b*, and 369*c*. As described above (in connection with the apparatus 108), the cam followers 376*a*, 376*b*, and 376*c* indirectly support the forming rollers 356*a*, 356*b*, and 356*c*.

In the apparatus 308, the hydraulic system 362 may include an accumulator or may include a relief valve.

Figure 7A:
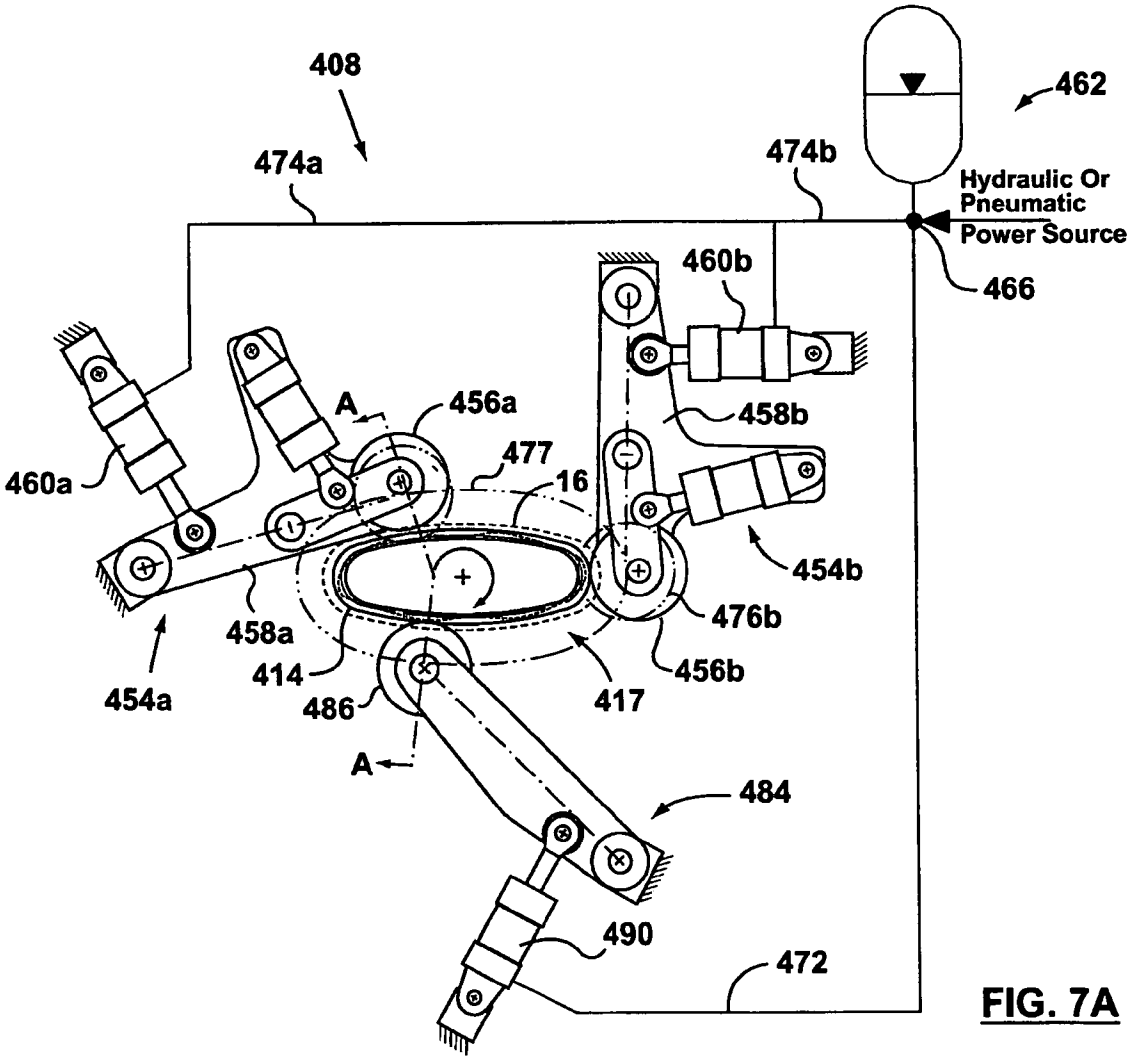
FIG. 7A is, in part, an end view of another alternative embodiment of the apparatus of the invention, and, in part, a schematic illustration of a portion of the embodiment.
Figure 7B:
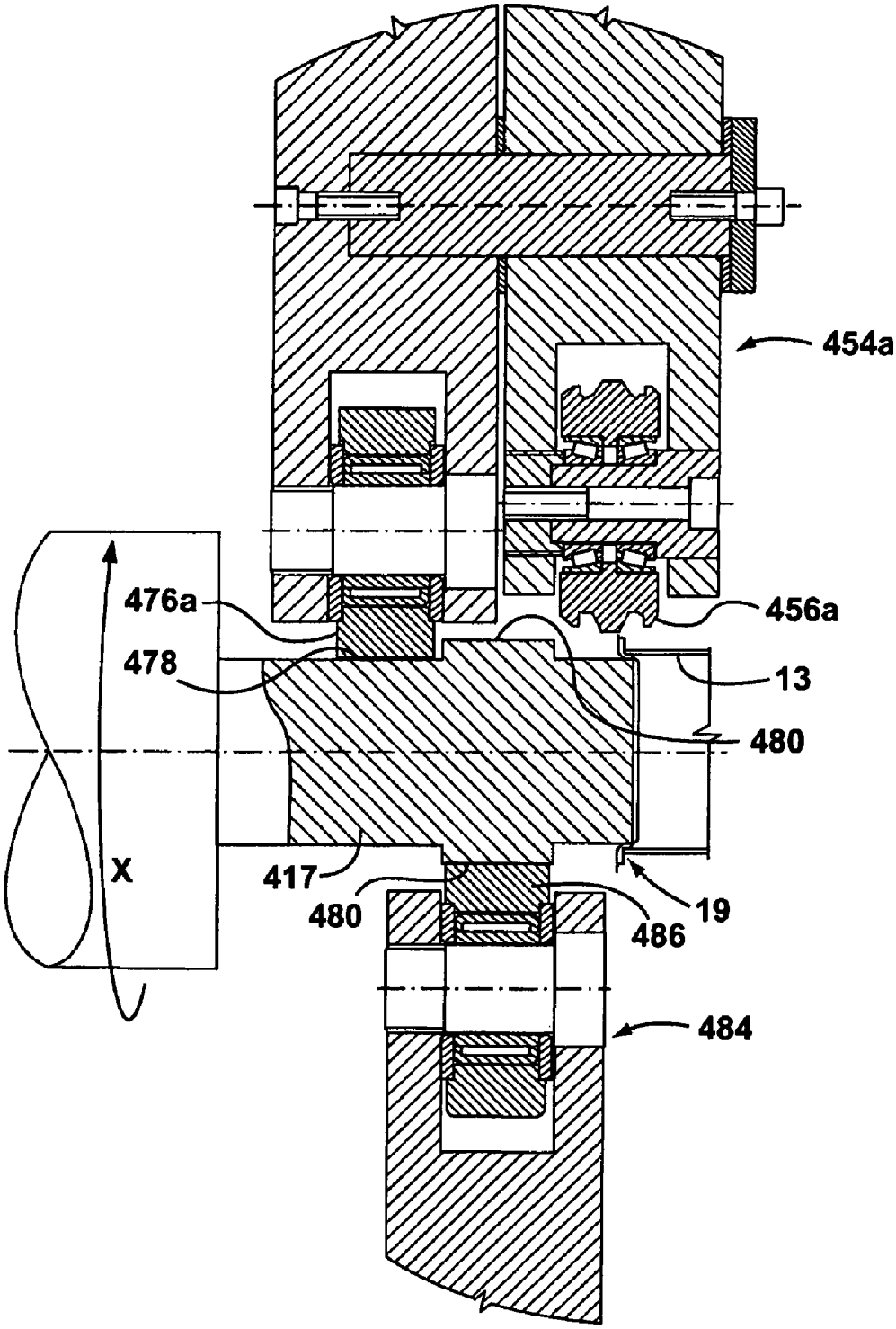
FIG. 7B is a cross-section of a portion of the apparatus of FIG. 7A taken along line A-A in FIG. 7A, drawn at a larger scale.
Figure 8:
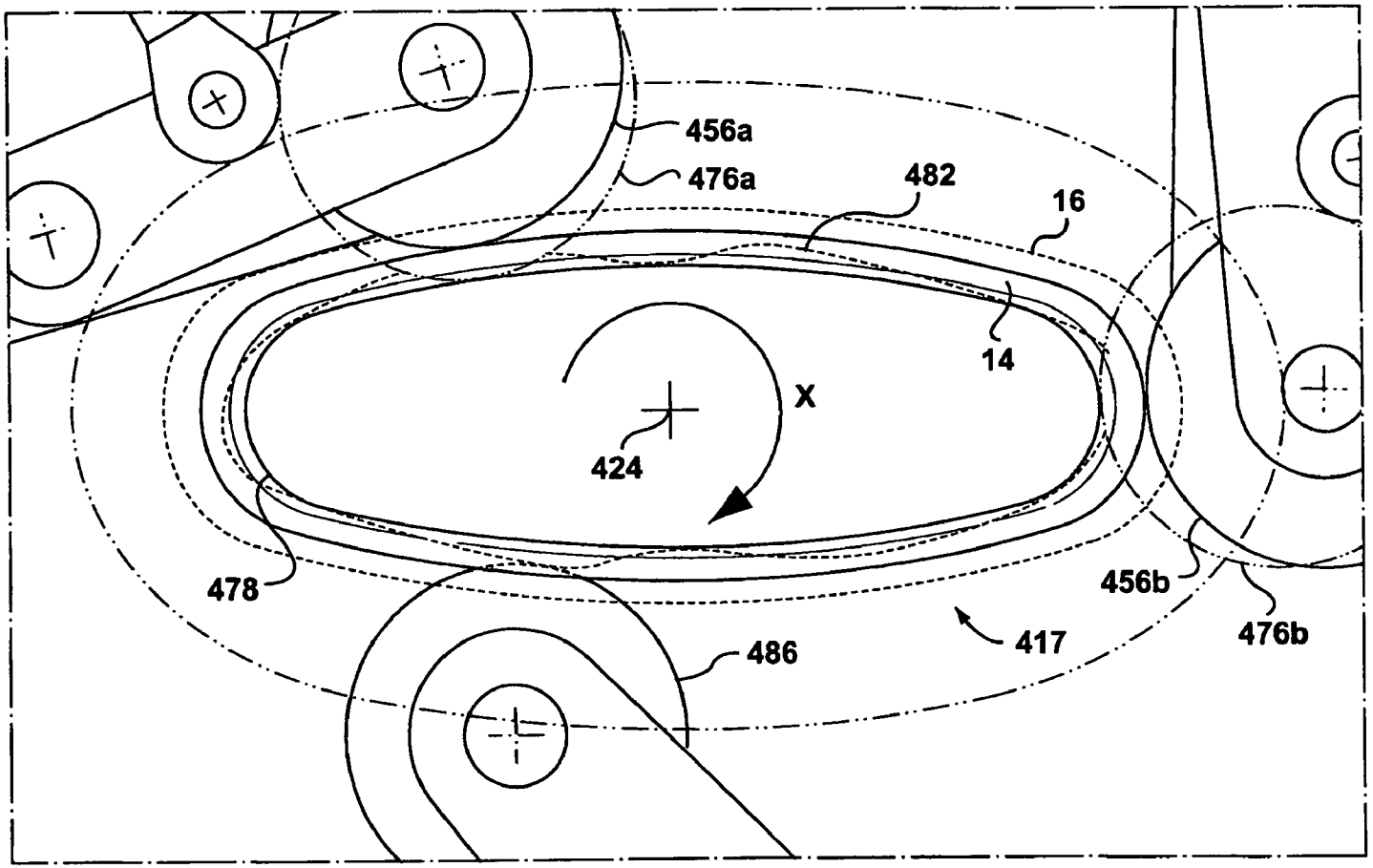
FIG. 8 is an end view of a portion of the apparatus of FIGS. 7A and 7B, drawn at a larger scale.
Figure 8A:
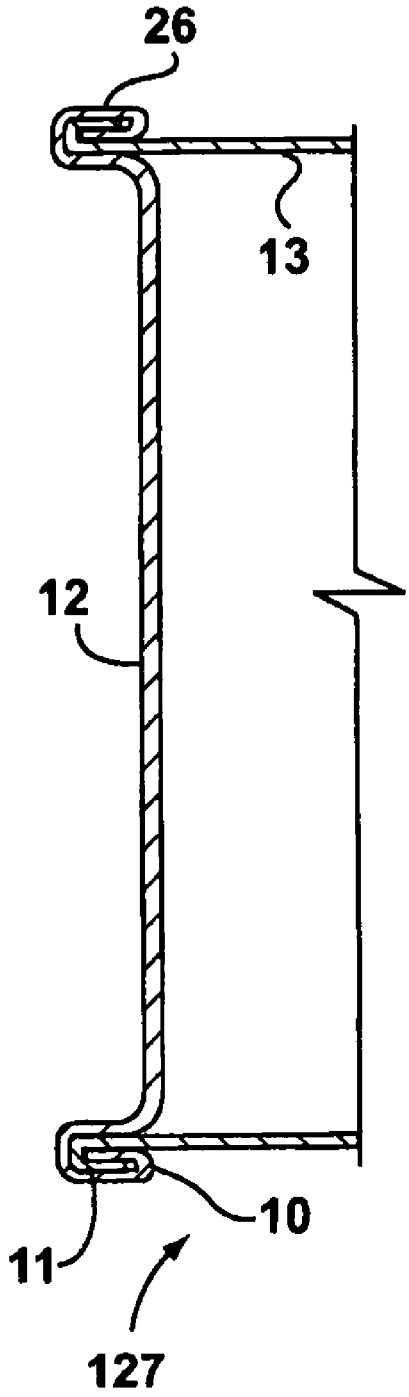
FIG. 8A is a cross-section of a portion of an embodiment of a housing of the invention, drawn at a smaller scale.

Another alternative embodiment of the apparatus 408 is disclosed in FIGS. 7A, 7B, and 8. The apparatus 408 preferably includes an elongate tool element 417 at least partially defined by a central axis 424 thereof and rotatable about the central axis 424. The tool element 417 is adapted for receiving the end cap 12 thereon. The tool element 417 includes a cam surface 480 thereon (FIG. 7B) with a balancing profile 482 thereby defined (FIGS. 7A, 8), as will be described. Preferably, the end cap 12 is adapted to receive at least part of the shell 13 to locate the shell flange 11 in the predetermined position relative to the end cap flange 10, to define the lip portion 19. The apparatus 408 preferably includes a number of roller subassemblies 454 for forming the lip portion into the lock seam portion 414. Each roller subassembly 454 preferably includes a forming roller 456 engageable with the lip portion 19 while the tool element 417 rotates. Preferably, each roller subassembly 454 additionally includes an arm 458 on which the forming roller thereof 456 is rotatably mounted, and a forming hydraulic cylinder 460 for positioning the arm 458 to engage the forming roller 456 with the lip portion 19.

As can be seen in FIG. 7A, the apparatus 408 also includes main arms 458*a*, 458*b* on which cam followers 476*a*, 476*b* are rotatably mounted respectively. The cam followers 476*a*, 476*b* engage a cam 478 (FIG. 7B).

The forming rollers 456*a*, 456*b* preferably are rotatably mounted on arms 467*a*, 467*b* respectively. Preferably, the arms 467*a*, 467*b* are supported by supplemental hydraulic cylinders 471*a*, 471*b* respectively. The arms 467*a*, 467*b* also preferably are connected to the main arms 458*a*, 458*b* via the supplemental hydraulic cylinders 471*a*, 471*b* and also at the pivot points 369*a*, 369*b*. As described above (in connection with the apparatus 108), the cam followers 476*a*, 476*b* indirectly support the forming rollers 456*a*, 456*b*.

It is also preferred that the apparatus 408 includes one or more idler subassemblies 484 including an idler 486 mounted on an idler arm 488. The idler arm 488 is positioned by an idler hydraulic cylinder 490 to engage the cam surface 480. Preferably, the cam surface 480 and the idler 486 are located in a plane which is spaced apart from the plane in which the forming rollers are located (FIG. 7B).

In one embodiment, the apparatus 408 preferably also includes a hydraulic system 462. The hydraulic system 462 includes a pump 466 which utilizes energy inputs thereto to subject hydraulic fluid to positive pressure in a positive direction, i.e., away from the pump's outlet. The forming hydraulic cylinders 460 and the idler hydraulic cylinder 488 are included in the hydraulic system 462, and are in fluid communication with the pump 466 (FIG. 7A). Each forming hydraulic cylinder 460 is adapted to subject the hydraulic fluid to alternating positive forming pressures and negative forming pressures while the tool element 417 rotates. Also, the idler hydraulic cylinder preferably is adapted to subject the hydraulic fluid to alternating positive idler pressures and negative idler pressures while the tool element 417 rotates.

Preferably, the idler 486 and the forming rollers 456 are positioned relative to each other so that the positive and negative forming pressures and the positive and negative idler pressures at least partially offset each other. The balancing profile 482 is determined so that the positive and negative idler pressures substantially offset the positive and negative forming pressures, for optimizing energy inputs into the pump. Ideally, the positive and negative idler pressures would equal the positive and negative forming pressures in each rotation of the tool element 117. However, due to friction, some energy inputs are required. Therefore, in practice, it is intended to optimize (i.e., minimize) energy inputs to the hydraulic system needed to maintain the forming rollers engaged with the lip portion.

The cam surface preferably is determined by first calculating the difference in the forming pressures so that the sum of the pressures produced by all the forming rollers and the idler will be approximately zero. For instance, the path of each forming roller may be considered in relatively small increments, and the net result of the positive and negative pressures produced by the forming rollers at each increment may be determined. Accordingly, once this has been calculated, the negative and positive pressures needed to be produced by the idler in order to result in a sum of the pressures produced by the forming hydraulic cylinders and the idler hydraulic cylinder of approximately zero. Based on such information, the balancing profile to be followed by the idler is determined.

It is preferred that two forming rollers and one idler are positioned substantially equidistant from each other measured radially relative to the central axis, as shown in FIG. 7A.

In the apparatus 408, the hydraulic system 462 may include an accumulator or a relief valve.

EXAMPLE

Figure 11:
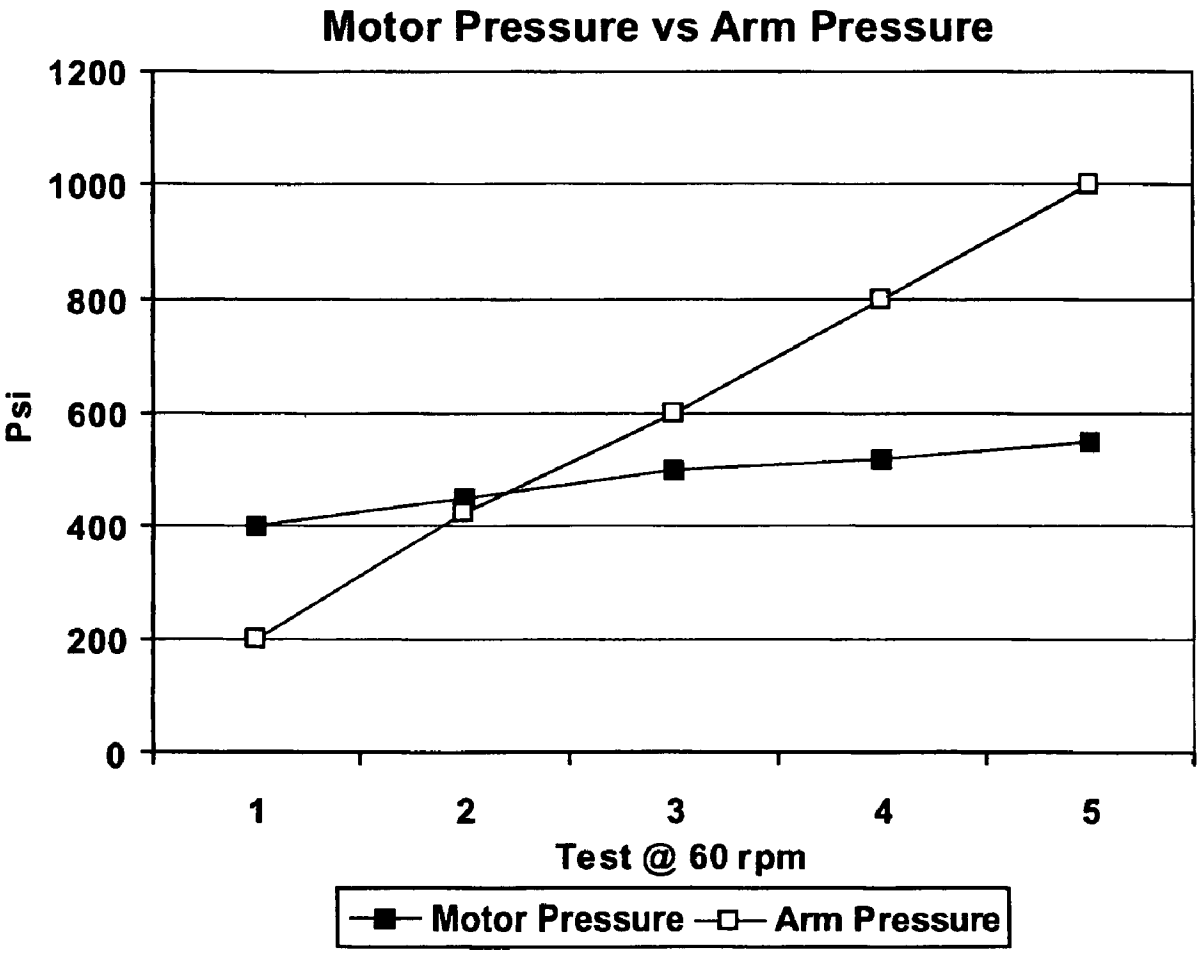
FIG. 11 is a graph showing certain test results for an embodiment of the apparatus of the invention.

Tests were conducted to assess the extent to which the idler (and the cam surface) would enable energy requirements to be reduced. The test results are shown in Table I, which results are presented in a graph as FIG. 11.

TABLE I

| Spindle Speed RPM | Hydraulic Motor Pressure PSI | Arm Pressure PSI |
|---|---|---|
| 60.5 | 400 | 200 |
| 60.1 | 450 | 425 |
| 60.0 | 500 | 600 |
| 60.3 | 520 | 800 |
| 60.2 | 550 | 1000 |
| 60.3 | 575 | 1200 |
| 60.0 | 600 | 1400 |
| 60.3 | 625 | 1600 |
| 60.0 | 650 | 1800 |
| 60.0 | 800 | 2100 |

A system including two forming rollers and one idler was tested by measuring the pressure required to drive the hydraulic motor driving the spindle (i.e., the tool element) around the central axis, and comparing such pressure to the total pressure applied to all of the two forming hydraulic cylinders and the idler hydraulic cylinder. In Table I, "hydraulic motor pressure" refers to the torque required to rotate the tool element 117, and "arm pressure" refers to the working forced needed to engage the forming rollers with the lip portion, i.e., the pressure inside hydraulic cylinders 360*a*, 360*b*.

In the test, cylinder pressure (i.e., the total of the pressures applied to the two forming cylinders and the idler cylinder) was increased from 200 psi (approximately 1,379 kPa) to 1,800 psi (approximately 12,411 kPa) and the corresponding hydraulic motor pressure required to maintain constant speed was measured. While total cylinder pressure was increased ninefold (i.e., from about 200 psi (approximately 1,379 kPa) to about 1,800 psi (approximately 12,411 kPa), hydraulic motor pressure increased from about 450 psi (approximately 3,103 kPa) to about 650 psi (approximately 4,482 kPa) (i.e., by a factor of about 1.625). This means that the power required to rotate the tool element only increased by a factor of about 1.625 while the working load increased by a factor of about nine.

To further test this version of the invention, the idler (and the idler arm) was removed, leaving only the two forming rollers positioned apart from each other by about 120°. However, the drive system was unable to maintain a substantially constant speed, and drive pressure fluctuated to such an extent that the test failed. This further supports the theory behind the hydraulic and dynamic balance of the idler and the forming rollers.

It has been determined that the total of the number of forming rollers and the number of idlers preferably should be an odd number. For example, if there is an even number of forming rollers, then there preferably should be an odd number of idlers, and vice versa. This is due to the geometry of the oval or irregularly-shaped shell, which is rotated about the central axis.

Figure 10A:
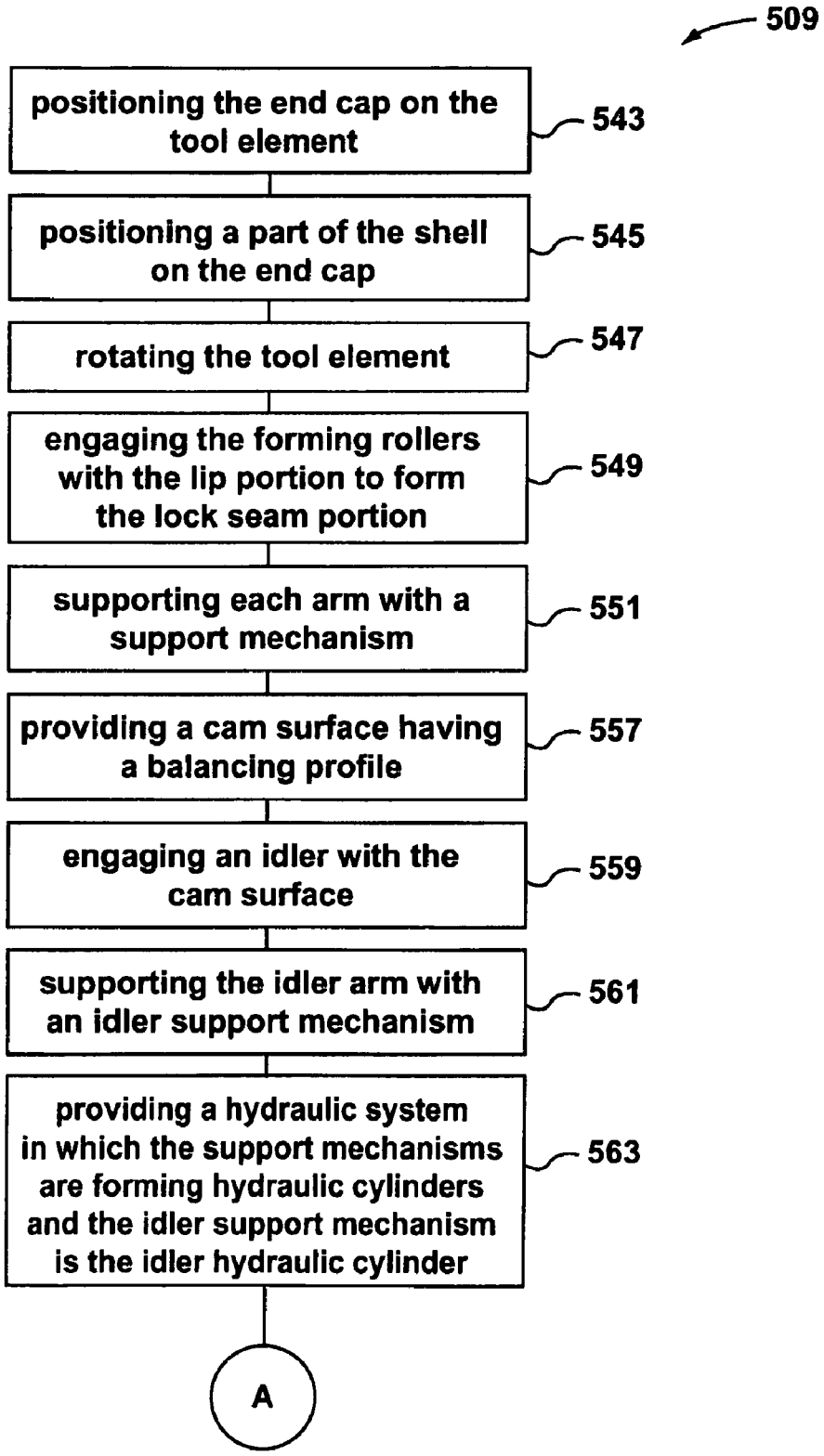
FIG. 10A is a schematic illustration of a portion of an alternative embodiment of a method of the invention.
Figure 10B:
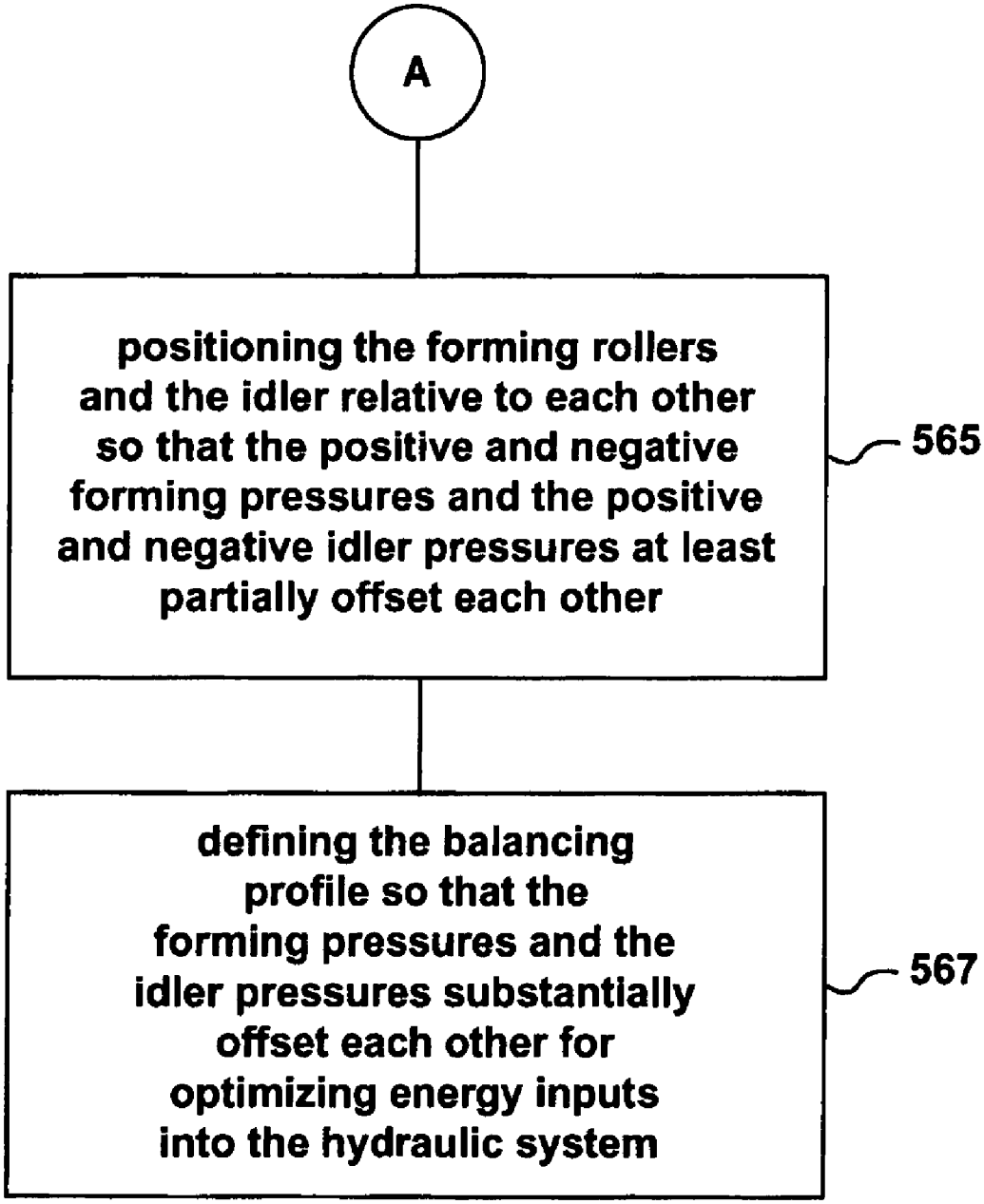
FIG. 10B is a schematic illustration of another portion of the alternative embodiment of the method of the invention partially illustrated in FIG. 10A.

An alternative embodiment of a method 509 of the invention includes, first, positioning the end cap 12 on the tool element 417 (step 543, FIG. 10A). At least a part of the shell 13 is positioned on the end cap 12 for locating the shell flange 11 in a predetermined position relative to the end cap flange 10, to define the lip portion 19 (step 545). The tool element 417 preferably is rotated about the central axis 424 thereof (step 547). A number of forming rollers 456 are engaged with the lip portion 19 while the tool element 417 rotates, to form the lip portion 19 into the lockseam portion 14 (step 549). Each arm 458 is supported with the support mechanism 460 respectively for positioning the arm 458 to engage the forming roller 456 mounted thereon with the lip portion 19 (step 551).

Preferably, the method 509 also includes providing a cam surface 480 on the tool element 417 with the balancing profile 482 thereby defined (step 557). It is also preferred that the idler 486 is engaged with the cam surface 480 (step 559), and the idler is positioned on the idler arm 488 which is supported by the idler support mechanism 490 for engagement with the cam surface 480 (step 561).

Preferably, the method 509 also includes providing the hydraulic system 462 (step 563). Preferably, the hydraulic system 462 includes a number of hydraulic cylinders 460 (being the support mechanisms) for supporting the arms 458 respectively. Each hydraulic cylinder 460 is in fluid communication with the pump 466.

The idler support mechanism 490 preferably is an idler hydraulic cylinder supporting the idler arm 488. The idler hydraulic cylinder 490 is in fluid communication with the pump.

Each hydraulic cylinder 460 is adapted to subject the hydraulic fluid to alternating positive forming pressures and negative forming pressures as the tool element rotates. Also, the idler hydraulic cylinder is adapted to subject the hydraulic fluid to alternating positive idler pressures and negative idler pressures as the tool element rotates.

The method 509 preferably also includes positioning the forming rollers and the idler relative to each other so that the positive and negative forming pressures and the positive and negative idler pressures at least partially offset each other (step 565). Also, the method 509 preferably includes defining the balancing profile so that the positive forming pressures and the negative forming pressures are substantially offset by the positive and negative idler pressures, for optimizing the energy inputs.

Preferably, the method 509 also includes positioning the forming rollers and the idler spaced substantially equally apart from each other measured radially relative to the central axis (step 567).

The housing 127 is formable in accordance with the method 509. The housing is shown in FIG. 8A. The housing preferably is formed by first, positioning the end cap 12 on the tool element 417 (step 543, FIG. 10A). At least a part of the shell 13 is positioned on the end cap 12 for locating the shell flange 11 in a predetermined position relative to the end cap flange 10, to define the lip portion 19 (step 545). The tool element 417 preferably is rotated about the central axis 424 thereof (step 547). A number of forming rollers 456 are engaged with the lip portion 19 while the tool element 417 rotates, to form the lip portion 19 into the lockseam portion 14 (step 549). Each arm 458 is supported with the support mechanism 460 respectively for positioning the arm 458 to engage the forming roller 456 mounted thereon with the lip portion 19 (step 551).

Preferably, the method 509 of forming the housing also includes providing a cam surface 480 on the tool element 417 with the balancing profile 482 thereby defined (step 557). It is also preferred that the idler 486 is engaged with the cam surface 480 (step 559), and the idler is positioned on the idler arm 488 which is supported by the idler support mechanism 490 for engagement with the cam surface 480 (step 561).

Preferably, the method 509 also includes providing the hydraulic system 462 (step 563). Preferably, the hydraulic system 462 includes a number of hydraulic cylinders 460 (being the support mechanisms) for supporting the arms 458 respectively. Each hydraulic cylinder 460 is in fluid communication with the pump 466.

The idler support mechanism 490 preferably is an idler hydraulic cylinder supporting the idler arm 488. The idler hydraulic cylinder 490 is in fluid communication with the pump.

Each hydraulic cylinder 460 is adapted to subject the hydraulic fluid to alternating positive forming pressures and negative forming pressures as the tool element rotates. Also, the idler hydraulic cylinder is adapted to subject the hydraulic fluid to alternating positive idler pressures and negative idler pressures as the tool element rotates.

The method 509 of forming the housing preferably also includes positioning the forming rollers and the idler relative to each other so that the positive and negative forming pressures and the positive and negative idler pressures at least partially offset each other (step 565). Also, the method 509 preferably includes defining the balancing profile so that the positive forming pressures and the negative forming pressures are substantially offset by the positive and negative idler pressures, for optimizing the energy inputs.

Preferably, the method 509 of forming the housing also includes positioning the forming rollers and the idler spaced substantially equally apart from each other measured radially relative to the central axis (step 567).

It will be understood that the order in which the steps of the methods of the invention are performed may be altered somewhat. For example, in method 209, the step of supporting each arm with a support mechanism may be taken prior to engaging the forming rollers with the lip portion. Alternatively, and as another example, the rollers may be engaged with the lip portion before the tool element is rotated.

It will be appreciated by those skilled in the art that the invention can take many forms, and that such forms are within the scope of the invention as claimed. The foregoing descriptions are exemplary, and their scope should not be limited to the specific versions described therein.

We claim:

1. An apparatus for securing at least one end cap including an end cap flange to a shell including a shell flange by forming a lip portion comprising the end cap flange and the shell flange into a lock seam portion in which the end cap flange and the shell flange are engaged with each other, the apparatus comprising:

an elongate tool element at least partially defined by a central axis thereof and rotatable about the central axis, the tool element being adapted for receiving said at least one end cap thereon;

said at least one end cap being adapted to receive at least part of the shell thereon to locate the shell flange in a predetermined position relative to the end cap flange;

a plurality of roller subassemblies for forming the lip portion into the lock seam portion, each said roller subassembly comprising a forming roller engageable with the lip portion while the tool element rotates;

each said roller subassembly additionally comprising an arm on which said forming roller thereof is rotatably mounted, and a support mechanism for positioning the arm to engage the forming roller with the lip portion;

a hydraulic system comprising:

a hydraulic fluid;

a pump for utilizing energy inputs therein to subject said hydraulic fluid to positive pressure in a positive direction relative to the pump;

a plurality of hydraulic cylinders, said hydraulic cylinders being the support mechanisms of the roller subassemblies respectively, each said hydraulic cylinder being in fluid communication with the other said hydraulic cylinders and with the pump; and each said hydraulic cylinder being adapted to subject said hydraulic fluid to alternating positive pressures and negative pressures in a negative direction opposite to the positive direction as the tool element rotates, the forming rollers being positioned relative to the central axis and relative to each other such that the positive and negative pressures at least partially offset each other, for optimizing said energy inputs.

2. An apparatus according to claim 1 comprising two roller subassemblies in which the forming rollers thereof respectively are positioned substantially at 90° from each other measured radially relative to the central axis.

3. An apparatus according to claim 1 comprising three roller subassemblies in which the forming rollers thereof respectively are positioned substantially at 120° from each other measured radially relative to the central axis.

4. An apparatus according to claim 1 in which the forming rollers are positioned substantially equidistant from each other radially relative to the central axis.

5. A method of securing at least one end cap including an end cap flange to a shell including a shell flange by forming a lip portion comprising the end cap flange and the shell flange into a lock seam portion in which the end cap flange and the shell flange are engaged with each other, the method comprising:

(a) positioning said at least one end cap on a tool element;

(b) positioning at least part of the shell on said at least one end cap on the tool element for locating the shell flange in a predetermined position relative to the end cap flange;

(c) rotating the tool element about a central axis thereof;

(d) engaging a plurality of forming rollers with the lip portion while the tool element rotates to form the lip portion into the lock seam portion, the forming rollers being mounted on arms respectively;

(e) supporting each said arm with a support mechanism respectively for positioning the arm to engage said forming roller mounted thereon with the lip portion;

(f) providing a hydraulic system comprising:

a hydraulic fluid;

a pump for utilizing energy inputs therein to subject said hydraulic fluid to positive pressure in a positive direction relative to the pump;

a plurality of hydraulic cylinders, said hydraulic cylinders being the support mechanisms of the roller subassemblies respectively, each said hydraulic cylinder being in fluid communication with the other said hydraulic cylinders and with the pump;

each said hydraulic cylinder being adapted to subject said hydraulic fluid to alternating positive pressures and negative pressures in a negative direction opposite to the positive direction as the tool element rotates; and (g) positioning said forming rollers relative to each other such that the positive and negative pressures resulting from rotation of the tool element at least partially offset each other, for optimizing said energy inputs.

6. A method according to claim 5 additionally comprising:

(h) providing more than two forming rollers; and (i) positioning each said forming roller substantially equidistant from each other measured radially relative to the central axis.

7. An apparatus for securing at least one end cap including an end cap flange to a shell including a shell flange by forming a lip portion comprising the end cap flange and the shell flange into a lock seam portion in which the end cap flange and the shell flange are engaged with each, the apparatus comprising:

an elongate tool element at least partially defined by a central axis thereof and rotatable about the central axis, the tool element being adapted for receiving said at least one end cap thereon;

said at least one end cap being adapted to receive at least part of the shell thereon to locate the shell flange in a predetermined position relative to the end cap flange;

a first roller subassembly for forming at least a part of the lip portion into a curled lip portion, the first roller subassembly comprising a first forming roller engageable with the lip portion while the tool element rotates;

the first roller subassembly additionally comprising a first arm on which the first forming roller is rotatably mounted, and a first support mechanism for positioning the first arm to engage the first forming roller with the lip portion to form the curled lip portion;

a second roller subassembly adapted for forming the curled lip portion into the lock seam portion to secure said at least one end cap to the shell, the second roller subassembly comprising a second forming roller engageable with the lip portion while the tool element rotates;

the second roller subassembly additionally comprising a second arm on which the second forming roller is rotatably mounted, and a second support mechanism for positioning the second arm to engage the second forming roller with the lip portion to form the lock seam portion;

a hydraulic system comprising:

a hydraulic fluid;

a pump for utilizing energy inputs therein to subject said hydraulic fluid to positive pressure in a positive direction relative to the pump;

a plurality of hydraulic cylinders, being the plurality of support mechanisms of the roller subassemblies respectively, each said hydraulic cylinder being in fluid communication with the other said hydraulic cylinders and with the pump; and each said hydraulic cylinder being adapted to subject said hydraulic fluid to alternating positive forming pressures and negative forming pressures in a negative direction opposite to the positive direction as the tool element rotates, the forming rollers being positioned relative to the central axis and relative to each other such that the positive and negative forming pressures at least partially offset each other, for optimizing said energy inputs.

8. An apparatus according to claim 7 in which:

the tool element additionally comprises a cam surface thereon comprising a balancing profile;

the apparatus additionally comprises at least one idler subassembly comprising an idler mounted on an idler arm, the idler arm being positioned by an idler hydraulic cylinder to engage the cam surface;

the hydraulic system additionally comprising the idler hydraulic cylinder;

the idler hydraulic cylinder being adapted to subject said hydraulic fluid to alternating positive idler pressures and negative idler pressures in the negative direction while the tool element rotates;

said idler and said forming rollers being positioned relative to each other such that the positive and negative forming pressures and the positive and negative idler pressures at least partially offset each other; and the balancing profile being determined such that the positive and negative idler pressures substantially offset said positive and negative forming pressures, for optimizing said energy inputs.

9. An apparatus according to claim 8 in which the forming rollers and the idler are positioned substantially equidistant from each other measured radially relative to the central axis.

10. An apparatus for securing at least one end cap including an end cap flange to a shell including a shell flange by forming a lip portion comprising the end cap flange and the shell flange into a lock seam portion in which the end cap flange and the shell flange are engaged with each other, the apparatus comprising:

an elongate tool element at least partially defined by a central axis thereof and rotatable about the central axis, the tool element being adapted for receiving said at least one end cap thereon;

the tool element comprising a cam surface thereon comprising a balancing profile;

said at least one end cap being adapted to receive at least part of the shell thereon to locate the shell flange in a predetermined position relative to the end cap flange;

a plurality of roller subassemblies for forming the lip portion into the lock seam portion, each said roller subassembly comprising a forming roller engageable with the lip portion while the tool element rotates;

each said roller subassembly additionally comprising an arm on which said forming roller thereof is rotatably mounted, and a forming hydraulic cylinder for positioning the arm to engage the forming roller with the lip portion;

at least one idler subassembly comprising an idler mounted on an idler arm, the idler arm being positioned by an idler hydraulic cylinder to engage the cam surface;

a hydraulic system comprising:

a hydraulic fluid;

a pump for utilizing energy inputs therein to subject said hydraulic fluid to positive pressure in a positive direction relative to the pump;

said forming hydraulic cylinders and said idler hydraulic cylinder, each said forming hydraulic cylinder and said idler hydraulic cylinder being in fluid communication with each other and with the pump;

each said forming hydraulic cylinder being adapted to subject said hydraulic fluid to alternating positive forming pressures and negative forming pressures in a negative direction opposite to the positive direction while the tool element rotates;

the idler hydraulic cylinder being adapted to subject said hydraulic fluid to alternating positive idler pressures and negative idler pressures in the negative direction while the tool element rotates;

said idler and said forming rollers being positioned relative to each other such that the positive and negative forming pressures and the positive and negative idler pressures at least partially offset each other; and the balancing profile being determined such that the positive and negative idler pressures substantially offset said positive and negative forming pressures, for optimizing said energy inputs.

11. An apparatus according to claim 10 in which two forming rollers and one idler are positioned substantially equidistant from each other measured radially relative to the central axis.

12. A method of securing at least one end cap including an end cap flange to a shell including a shell flange by forming a lip portion comprising the end cap flange and the shell flange into a lock seam portion in which the end cap flange and the shell flange engaged with each other, the method comprising:

(a) positioning said at least one end cap on a tool element;

(b) positioning at least part of the shell on said at least one end cap on the tool element for locating the shell flange in a predetermined position relative to the end cap flange;

(c) rotating the tool element about a central axis thereof;

(d) engaging a plurality of forming rollers sequentially with the lip portion while the tool element rotates to form the lip portion into the lock seam portion, the forming rollers being mounted on arms respectively;

(e) supporting each said arm with a support mechanism respectively for positioning the arm to engage said forming roller mounted thereon with the lip portion;

(f) providing a cam surface on the tool element, the cam surface comprising a balancing profile;

(g) engaging at least one idler with said cam surface while the tool element rotates, said at least one idler being mounted on an idler arm;

(h) supporting the idler arm with an idler support mechanism for positioning the idler arm to engage said at least one idler with the cam surface;

(i) providing a hydraulic system comprising:

a hydraulic fluid;

a pump for utilizing energy inputs therein to subject said hydraulic fluid to positive pressure in a positive direction relative to the pump;

a plurality of forming hydraulic cylinders respectively supporting the arms, said forming hydraulic cylinders being the support mechanisms of the roller subassemblies respectively, each said forming hydraulic cylinder being in fluid communication with the pump;

an idler hydraulic cylinder supporting the idler arm, said idler hydraulic cylinder being the idler support mechanism, said idler hydraulic cylinder being in fluid communication with the pump;

said forming hydraulic cylinders and said idler hydraulic cylinder being in fluid communication with each other;

each said hydraulic cylinder being adapted to subject said hydraulic fluid to alternating positive forming pressures and negative forming pressures in a negative direction opposite to the positive direction as the tool element rotates;

said idler hydraulic cylinder being adapted to subject said hydraulic fluid to alternating positive idler pressures and negative idler pressures in the negative direction as the tool element rotates;

(j) positioning said forming rollers and said idler relative to each other such that the positive and negative forming pressures and the positive and negative idler pressures at least partially offset each other; and (k) defining the balancing profile such that the positive forming pressures and negative forming pressures are substantially offset by the positive and negative idler pressures, for optimizing said energy inputs.

13. A method according to claim 12 additionally comprising:

(l) positioning said forming rollers and said at least one idler spaced substantially equally apart from each other measured radially relative to the central axis.

* * * * *